United States Patent [19]

Vakil

[11] 4,179,898

[45] Dec. 25, 1979

[54] VAPOR COMPRESSION CYCLE DEVICE WITH MULTI-COMPONENT WORKING FLUID MIXTURE AND METHOD OF MODULATING ITS CAPACITY

[75] Inventor: Himanshu B. Vakil, Schenectady, N.Y.

[73] Assignee: General Electric Company, Schenectady, N.Y.

[21] Appl. No.: 929,339

[22] Filed: Jul. 31, 1978

[51] Int. Cl.[2] ..... F25B 00/00

[52] U.S. Cl. ..... 62/114; 62/502; 62/503; 62/174; 62/509; 62/512

[58] Field of Search ..... 62/114, 502, 503, 509, 62/512, 174

[56] References Cited

U.S. PATENT DOCUMENTS

| | | | |
|---|---|---|---|
| 2,277,138 | 3/1942 | Newton | 62/114 X |
| 2,492,725 | 12/1949 | Ashley | 62/115 |
| 2,682,756 | 7/1954 | Clark et al. | 62/502 X |
| 2,794,322 | 6/1957 | Etherington | 62/114 |
| 2,794,328 | 6/1957 | Herrick | 62/114 X |
| 2,807,943 | 10/1957 | Lynch et al. | 62/115 |
| 2,836,966 | 6/1958 | Kocher et al. | 62/503 X |
| 2,986,898 | 6/1961 | Wood, Jr. | 62/512 X |
| 3,237,422 | 3/1966 | Pugh | 62/174 X |
| 3,500,656 | 3/1970 | Lofgreen et al. | 62/216 X |
| 4,003,215 | 1/1977 | Roach | 62/476 |

*Primary Examiner*—Lloyd L. King

*Attorney, Agent, or Firm*—Paul R. Webb, II; Joseph T. Cohen

[57] ABSTRACT

A vapor compression cycle device is described which includes a multi-component working fluid mixture, condensing heat exchanger and an associated vapor-liquid separator connected to the compressor, a high-pressure liquid accumulator connected to the condenser and associated separator, a flow restricting device connected to the condenser and associated separator, an evaporating heat exchanger and associated low-pressure accumulator connected to the flow restricting device, and the evaporating heat exchanger and low-pressure accumulator connected to the compressor. A method is described also to modulating the capacity of such a device.

8 Claims, 2 Drawing Figures

Figure 1:
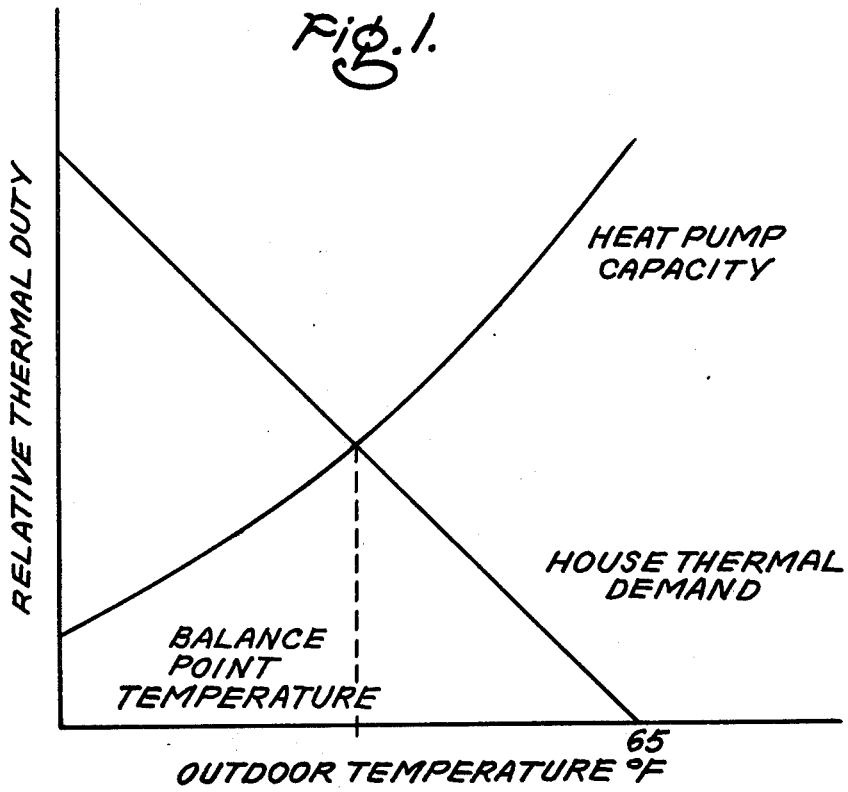

VAPOR COMPRESSION CYCLE DEVICE WITH MULTI-COMPONENT WORKING FLUID MIXTURE AND METHOD OF MODULATING ITS CAPACITY

This invention relates to a vapor compression cycle device and to a method of modulating its capacity and, more particularly to such a device with a multi-component working fluid mixture and to a method of modulating its capacity.

A single refrigerant heat pump is described in U.S. Pat. No. 2,807,943 issued Oct. 1, 1957, under the title "Heat Pump Including Means For Controlling Effective Refrigerant Charge." The heat pump of the subject patent includes a refrigerant container positioned between the indoor heat exchanger and the flow restricting means for charging the effective refrigerant charge in the circuit.

A mixed refrigerant system is described in U.S. Pat. No. 2,492,725 issued Dec. 27, 1949, under the title "Mixed Refrigerant System." The subject heat pump includes a liquid receiver and expansion valve between the outdoor heat exchanger and the indoor heat exchanger.

A refrigerant system is described in U.S. Pat. No. 4,003,215, under the title "Absorption Refrigeration System." The subject system utilizes a pair of fluorocarbon compounds in which one fluid is separated from the other fluid by a distillation process. The separated fluid is circulated through the refrigeration system.

Reference is made to copending patent application Ser. No. 926,510, filed July 20, 1978, which is entitled "Vapor Compression Cycle Device With Multi-Component Working Fluid Mixture And Method of Modulating Its Capacity." This copending application describes a vapor compression cycle device with a multi-component working fluid mixture, a high-pressure liquid accumulator with an associated flow restricting device positioned between the condensing heat exchanger and the evaporating heat exchanger, and a liquid accumulator positioned between the evaporating heat exchanger and the compressor.

Reference is made to copending patent application Ser. No. 927,032, filed July 24, 1978, which is entitled "Vapor Compression Cycle Device With Multi-Component Working Fluid Mixture and Improved Condensing Heat Exchanger." This copending application describes a vapor compression cycle device which includes a multi-component working fluid mixture and a condensing heat exchanger having a plurality of sequentially connected working fluid tube rows. Both of the above copending patent applications are assigned to the same assignee as the present application.

Our present invention is directed to a vapor compression cycle device which is opposed to the above patents and is an improvement over the above-identified copending application Ser. Nos. 926,510, and 927,032, in that it includes a multi-component working fluid mixture, a condensing heat exchanger and an associated vapor-liquid separator connected to the compressor, a high-pressure liquid accumulator connected to the condenser and associated vapor-liquid separator, a flow restricting device connected to the condenser and associated separator and the high-pressure accumulator, and connected to an evaporating heat exchanger and an associated low-pressure accumulator.

The primary objects of my invention are to provide an improved vapor compression cycle device with a multi-component working fluid mixture, and to provide a method of modulating the capacity of such a device whether operating in a heating or in a cooling mode.

In accordance with one aspect of my invention, a vapor compression cycle device includes a closed working fluid circuit, a multi-component fluoro-carbon working fluid mixture, a compressor, a condensing heat exchanger and associated vapor-liquid separator connected to the compressor, a high-pressure liquid accumulator connected to the condenser and associated separator, a flow restricting device connected to the condenser and associated separator, an evaporating heat exchanger and associated low-pressure accumulator connected to the flow restricting device, and the evaporating heat exchanger and low-pressure accumulator connected to the compressor.

Figure 2:
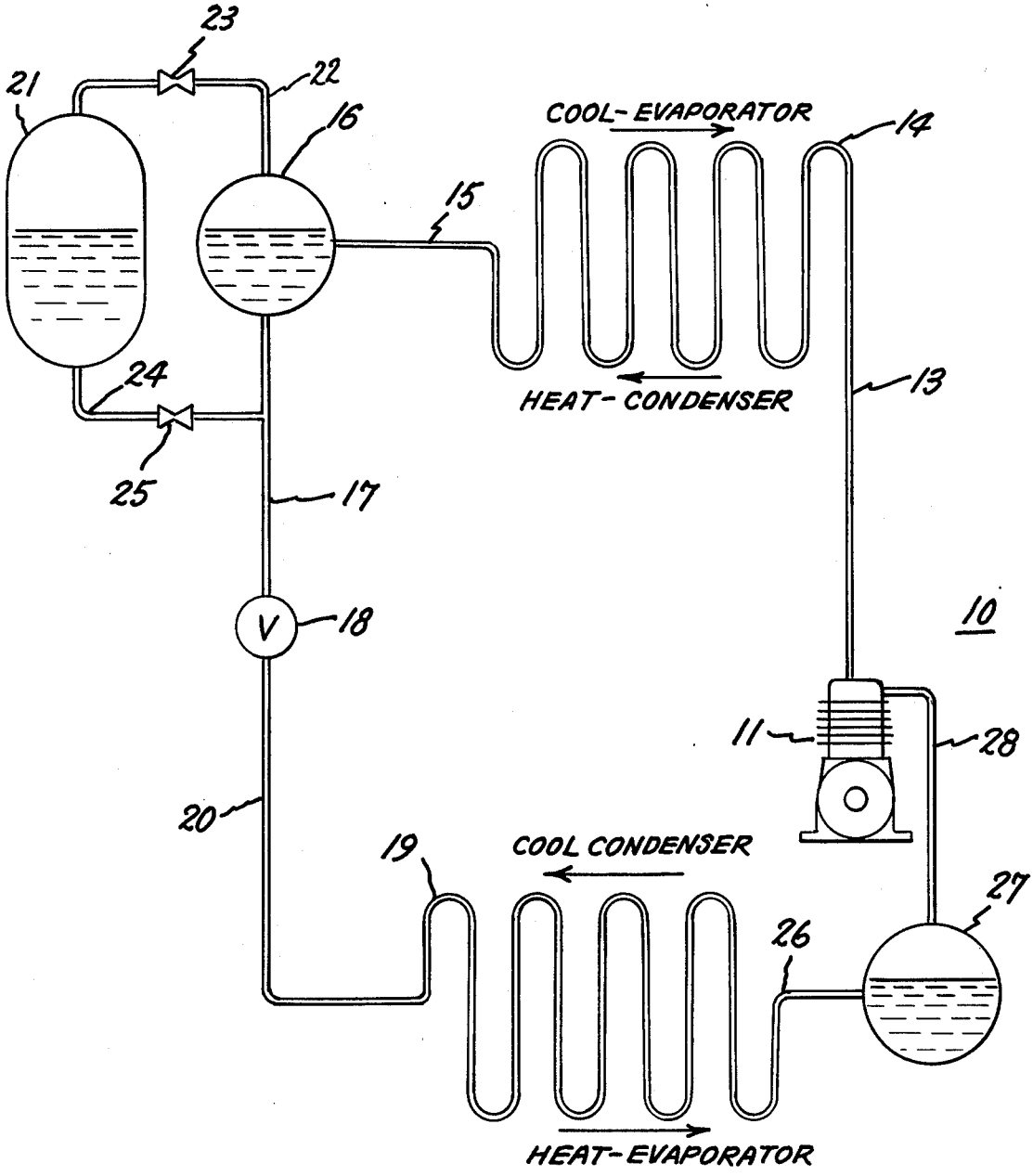

These and various other objects, features and advantages of the invention will be better understood from the following description taken in connection with the accompanying drawing in which:

FIG. 1 of the drawing is a schematic graph exhibiting a typical contrast between the house thermal demand and the heating capacity of a vapor compression cycle device operating in the heating mode as a function of evaporator temperature; and FIG. 2 is a schematic view partially in section of a vapor compression cycle device made in accordance with my invention.

In FIG. 1, which is a schematic graph, there is exhibited a typical contrast between the house thermal demand and vapor compression cycle device capacity as a function of evaporator temperature. Conventional device designs suffer from a major disadvantage in the capacity versus evaporator temperature characteristics of the devices. Ideally, one would like the device to have a capacity versus evaporator temperature characteristic resembling that of the house. Unfortunately, in case of existing devices there is a wide mismatch in the two characteristics. As consequences, above the balance point temperature there are two sources of inefficiencies; one existing from an overloading of the heat exchangers that operate with high temperature differences resulting in associated thermodynamic penalties, and the other arising out of the startup and shutdown transients resulting from a reduced operational duty factor. Below the balance point temperature, additional inefficiencies result from the necessity to utilize additional heating at associated low efficiencies in order to make up the difference between the house demand and the device supply.

My invention provides an improved vapor compression cycle device that has a higher capacity for a lower outdoor temperature over the bulk of heating season.

In FIG. 2 of the drawing, there is shown a vapor compression cycle device 10 with a multi-component working fluid mixture made in accordance with my invention. Device 10 in the heating mode has a compressor 11 for the working fluid mixture. Tube 13 connects compressor 11 to the inlet side of condensing heat exchanger 14. Tube 15 connects the outlet side of condensing heat exchanger 14 to a vapor-liquid separator 16. A tube 17 connects vapor-liquid separator 16 to a flow restricting device 18 in the form of an expansion valve. An evaporating heat exchanger 19 is connected to expansion valve 18 by a tube 20. A high-pressure-liquid accumulator 21 is connected at its upper portion as shown in FIG. 2 by a tube 22 with a regulating valve 23 to the upper vapor portion of vapor-liquid separator 16. High-pressure-liquid accumulator 21 is connected at its lower portion as shown in FIG. 2 by a tube 24 with a regulating valve 25 to tube 17. A tube 26 connects the outlet side of exchanger 19 to a low-pressure liquid accumulator 27. Compressor 11 is connected to the outlet side of accumulator 27 by a tube 28. Thus, a closed system is provided containing a multi-component mixed working fluid that flows cyclicly through the entire system.

My vapor compression cycle device has improved capacity versus outdoor temperature characteristics. My device has a high-pressure liquid accumulator connected to a vapor-liquid separator between the condensing heat exchanger and the evaporating heat exchanger to maximize condensation of the working fluid mixture, and a low-pressure-liquid accumulator positioned between the evaporating heat exchanger and the compressor. My method modulates the capacity of such a device. This device matches the house thermal demand over a range of evaporator temperatures. This range can be selected to give maximum benefit during the bulk of heating season by reducing vastly the disadvantages inherent in auxilliary heating below conventional balance point temperatures and thermal degradation through heat exchanger overloading above the balance point temperatures which is shown in FIG. 1 of the drawing.

Various multi-component working fluid mixtures can be employed. Such mixtures, which have two or more components, must have different vapor pressures and the mixture components must be miscible over the range of operation. I prefer multi-component fluorocarbon working fluid mixtures. Such multi-component fluoro-carbon working fluid mixtures can be selected from such mixtures described in above-referenced U.S. Pat. No. 4,003,215. As opposed to this patent wherein one working fluid is separated from the other working fluid by distillation prior to circulation in the refrigerant system, the present vapor compression cycle device circulates the working fluids as a mixture. The capacity versus evaporator temperature characteristics of a single component working fluid is limited by the dependence of the working fluid vapor pressure on the temperature of the evaporator heat exchanger. The present invention uses advantageously changes in the composition of the mixed working fluid to alter the compressor molar flow rate to accomodate the changes in evaporator temperature.

During the heating mode of vapor compression cycle device 10, compressor 11 circulates mixed working fluid vapor through tube 13 to condensing heat exchanger 14. The mixed working fluid flows from exchanger 14 through tube 15 to a vapor-liquid separator 16. The working fluid mixture is separated in separator 16 into a liquid portion and a vapor portion. The liquid portion flows through tubes 17 and 20 to evaporating heat exchanger 19, which flow is controlled by flow restricting device 18. The uncondensed vapor portion flows through tube 22 and valve 23 into high-pressure accumulator 21 and is condensed to liquid in either tube 22 or in accumulator 22. A reduction in the capacity of device 10 is achieved by an increase in the flow of the uncondensed vapor and its condensation which is regulated by valve 23. Conversely, an increase in the capacity of device 10 is accomplished by allowing the liquid mixture in accumulator 21 to flow through tube 24, valve 25 and tube 20 to evaporating heat exchanger 19, which flow is controlled by flow restricting device 18. The mixed working fluid vapor and liquid flow from exchanger 19 through tube 26 to low-pressure accumulator 27. Compressor 11 receives mixed working fluid mostly as vapor from accumulator 27 through tube 28 to complete the heating mode.

In the embodiment shown in FIG. 2, vapor-liquid separator 16 is shown connected to the outlet end of condensing heat exchanger 14. It will be appreciated that separator 16 can be positioned otherwise whereby condensing heating exchanger 14 has an associated separator 16. Similarly, low-pressure accumulator 27 is shown in the embodiment of FIG. 2 as being connected to the outlet of evaporating heat exchanger 19. It will also be appreciated that exchanger 19 can be positioned otherwise whereby evaporating heat exchanger 19 has an associated low-pressure accumulator 27.

At a high evaporator temperature for the heating mode, as shown in FIG. 1 of the drawing, expansion valve 18 in FIG. 2 of the drawing is controlled by conventional equipment to adjust the flow rate of the mixed working fluid from separator 16 and accumulator 21 whereby a first level of working fluid is attained in separator 16 and in accumulator 21. This control of expansion valve 21 will deplete the mixed working fluid to a first level in accumulator 27. In this manner, the working fluid in the low-pressure accumulator is enriched in the high boiling point working fluid component and its vapor pressure is reduced to its lowest level. This results in the lowest molar flow rate through the compressor and hence the lowest capacity for this evaporator temperature. As the evaporator temperature drops, expansion valve 18 is controlled to allow increasing quantities of mixed working fluid from separator 16 and accumulator 21 to pass through heat exchanger 19 into accumulator 27. This increase in flow of mixed working fluid from separator 16 and accumulator 21 through heat exchanger 19 to accumulator 27 enriches the working fluid in the lighter or lower boiling point working fluid component. The total pressure in accumulator 27 increases with a resulting increase in the molar flow rate through compressor 11. As the temperature continues to drop, expansion valve 18 allows the liquid in separator 16 and accumulator 21 to fall to a lower level and increases the level in accumulator 27. In this manner, the process of increasing or enriching the working fluid in its lower boiling point component is continued. This increases the compressor inlet density with increased molar pumping flow rate of the compressor. As the temperature drops further, exchange valve 18 allows all of the working fluid liquid in separator 16 and accumulator 21 to be depleted, which working fluid passes through exchanger 19 and into accumulator 27 with an associated increase in the molar pumping flow rate of the compressor to its maximum value yielding the maximum device capacity for this lower evaporator temperature. Thus, my device modulates its capacity versus the evaporator temperature to match indoor thermal demand. As the evaporator temperature increases in the heating mode, modulation is obtained by initially decreasing the flow rate of the mixed working fluid from separator 16 and accumulator 21 which are controlled selectively by flow restricting device 18. In this manner, the mixed working fluid level in accumulator 27 may be restored to previous levels in response to increasing evaporator temperatures. A temperature range can be chosen to encompass the bulk of heating season by the flexibility in the number of refrigerants employed and their vapor-pressure versus temperature characteristics.

The capacity of my vapor compression cycle device is modulated during its heating mode by circulating a multi-component working fluid mixture vapor from a compressor to a condenser. The liquid from the condenser is circulated to a vapor-liquid separator and to a high-pressure accumulator whereby complete condensation is achieved. The mixture is circulated from the separator and the accumulator to an evaporator. The flow of the mixture from the accumulator to the evaporator is controlled selectively in response to changes in the evaporator temperature by an associated flow restricting device. The mixture is then flowed to a low-pressure accumulator. The density of the vapor in equilibrium with the liquid mixture in the low-pressure accumulator controls the rate of compression or the molar flow of the mixture to and through the compressor.

At the higher outdoor temperatures, the complete condensation of and the restricted flow of the working fluid mixture from the separator and the high-pressure accumulator results in the working fluid mixture which is circulated to the evaporator, being enriched in the high boiling point working fluid component. As the evaporator temperature decreases, the increase of mixture flow from the separator and the high-pressure accumulator enriches the working fluid mixture in the low boiling point component. The additional flow of working fluid mixture through the evaporator and to the low-pressure accumulator results in a pressure increase in the low-pressure accumulator. The increase in working fluid mixture in the low-pressure accumulator increases the vapor density. The change from a low to a higher density in the vapor in the low-pressure accumulator increases the flow rate of the mixture through the compressor with a consequent increase in the heat exchanger duties and the compressor power input. Thus, my method provides for modulation of the capacity of the present device during its heating mode.

In my improved device and method, the complete condensation of the mixed working fluid from the condensing heat exchanger is accomplished by the employment of the high-pressure accumulator connected to the vapor-liquid separator. If, for example, the multi-component working fluid mixture in the present device is Freon 22 and 114 fluorinated hydrocarbon working fluid with an average charge composition of 50 percent Freon 22 fluorinated hydrocarbon fluid, the theoretical maximum change in the composition in percentage of Freon 22 fluorinated hydrocarbon fluid is greatly increased. The high-pressure accumulator liquid change is from 50 to 95 percent. The device fluid change is from 20 to 85 percent. The low-pressure accumulator liquid change is from 5 to 50 percent. These changes are even more pronounced if more than two working fluid mixture components are used with a greater separation between the highest boiling point component and the lowest boiling point component.

While other modifications of the invention and variations thereof which may be employed within the scope of the invention have not been described, the invention is intended to include such as may be embraced within the following claims:

What I claim as new and desire to secure by Letters Patent of the United States is:

1. A method of modulating the capacity of a vapor compression cycle device which comprises compressing a multi-component working fluid mixture, condensing the mixture vapor, separating the vapor and liquid, storing the liquid under high pressure, condensing selectively the separated vapor and storing the condensed liquid under high pressure, controlling separately the flow rate of the stored condensed liquids, evaporating the liquid, storing the mixture under low pressure, and controlling the flow rate of compression by the density of the vapor of the mixture under low pressure.

2. A method of modulating the capacity of a vapor compression cycle device as in claim 1, in which the mixture is a multi-component fluoro-carbon working fluid.

3. A method of modulating the capacity of a vapor compressor cycle device which comprises compressing a multi-component working fluid mixture, circulating the mixture vapor to a condenser and an associated vapor-liquid separator, condensing the mixture vapor, circulating selectively the mixture vapor from the condenser and associated vapor-liquid separator to a high-pressure accumulator, condensing the mixture vapor and storing the condensed liquid in the high-pressure accumulator, controlling separately circulation of the mixture liquid from the condenser and associated separator and the accumulator to an evaporator and an associated low-pressure accumulator, maintaining the unevaporated mixture under low pressure, circulating the mixture from the evaporator and associated low-pressure accumulator to the compressor, and controlling the flow of the mixture to and through the compressor by the density of the vapor of the mixture under low pressure.

4. A method of modulating the capacity of a vapor compression cycle device which comprises compressing a multi-component working fluid mixture, circulating the mixture vapor to a condenser, condensing the mixture vapor, circulating the mixture vapor and liquid to a vapor-liquid separator, separating the vapor and liquid, circulating selectively the mixture vapor from the separator to a high-pressure accumulator, condensing the mixture vapor from the separator and storing the condensed liquid in the high-pressure accumulator, controlling separately the circulation of the mixture liquid from the separator and the accumulator to an evaporator and an associated low-pressure accumulator, maintaining the unevaporated mixture under low pressure, circulating the mixture from the evaporator and associated low-pressure accumulator to the compressor, and controlling the flow of the mixture to and through the compressor by the density of the vapor of the mixture under low pressure.

5. A vapor compression cycle device comprising a closed working fluid circuit, a multi-component working fluid mixture in the circuit, the closed working fluid circuit comprising a compressor, a condensing heat exchanger and associated vapor-liquid separator connected to the compressor, a high-pressure accumulator connected to the condenser and associated separator, a flow restricting device connected to the condenser and associated separator and to the high-pressure accumulator, an evaporating heat exchanger and associated low-pressure accumulator connected to the flow restricting device, and the evaporating heat exchanger and low-pressure accumulator connected to the compressor.

6. A vapor compression cycle device as in claim 5, in which the flow restricting device is controlled selectively in response to the evaporator temperature.

7. A vapor compression cycle device as in claim 5, in which the mixture is a multi-component fluoro-carbon working fluid.

8. A vapor compression cycle device as in claim 5, in which the flow restricting device is controlled selectively in response to the condensing temperature.

* * * * *